US012667213B2

(12) United States Patent
Cooksey et al.

(10) Patent No.: US 12,667,213 B2
(45) Date of Patent: Jun. 30, 2026

(54) DRESSING ASSISTANCE DEVICE AND DRESSING ASSISTANCE METHOD

(71) Applicant: TORCHWARD, LTD., North Olmsted, OH (US)

(72) Inventors: Benjamin Cooksey, North Olmsted, OH (US); Timothy Leo, North Olmsted, OH (US); Nicholas Sajka, North Olmsted, OH (US)

(73) Assignee: TORCHWARD, LTD., North Olmsted, OH (US)

( * ) Notice: Subject to any disclaimer, the term of this patent is extended or adjusted under 35 U.S.C. 154(b) by 0 days.

(21) Appl. No.: 18/911,601

(22) Filed: Oct. 10, 2024

(65) Prior Publication Data

US 2026/0102009 A1 Apr. 16, 2026

(51) Int. Cl.
*A47G 25/90* (2006.01)

(52) U.S. Cl.
CPC ..... *A47G 25/907* (2013.01); *A47G 25/908* (2013.01); *A47G 2200/046* (2013.01)

(58) Field of Classification Search
CPC .... A47G 25/90; A47G 25/905; A47G 25/907; A47G 25/908
See application file for complete search history.

(56) References Cited

U.S. PATENT DOCUMENTS 446,169 A * 2/1891 Sommerfeld ..... A47B 13/16 38/140
5,636,774 A 6/1997 Moscato
6,102,262 A 8/2000 Nicholson
7,395,951 B2 7/2008 Clayman
7,527,181 B1 * 5/2009 Sullivan ..... A47G 25/904 223/111
8,356,735 B1 * 1/2013 Drakeford ..... A47G 25/905 223/112
8,393,503 B2 3/2013 Moscato
9,072,397 B2 7/2015 Clifton
10,918,233 B2 2/2021 Shahar
2009/0120975 A1 5/2009 Schoepe
2010/0096418 A1 4/2010 Cockman
2017/0105562 A1 * 4/2017 Milligan ..... A47G 25/905
2018/0242766 A1 8/2018 Leonard
2018/0242767 A1 * 8/2018 Herzig ..... A47G 25/905

FOREIGN PATENT DOCUMENTS

JP 3210683 U * 6/2017 ..... A47G 25/905
WO WO-2014202083 A1 * 12/2014 ..... A47G 25/908

* cited by examiner

*Primary Examiner* — Nathan E Durham
(74) *Attorney, Agent, or Firm* — Renner, Otto, Boisselle & Sklar, LLP

(57) ABSTRACT

A dressing assistance device may include a rest frame structure for supporting a limb of a user, a guide rail disposed along a longitudinal direction of the rest frame structure, a mount support section movably connected to the guide rail, a garment mount section coupled to the mount support section for receiving attachment of a garment, a mount adjustment section coupled to the mount support section for adjusting a width of the garment mount section, and a motor coupled to the mount support section and the mount adjustment section. The motor may drive the mount support section to travel along the guide rail. The motor may drive the mount adjustment section to adjust the garment mount section between a closed position for receiving attachment of a garment and an open position that allows for insertion and removal of the limb of the user.

17 Claims, 7 Drawing Sheets

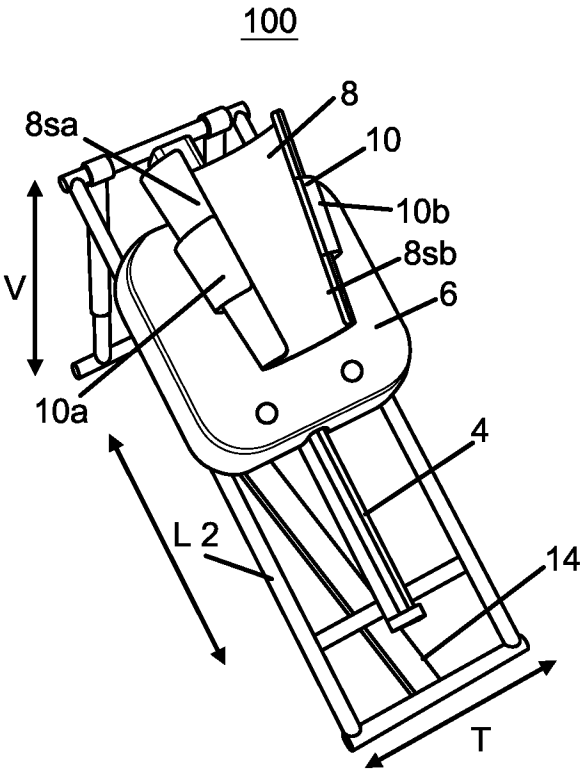
FIG. 6B
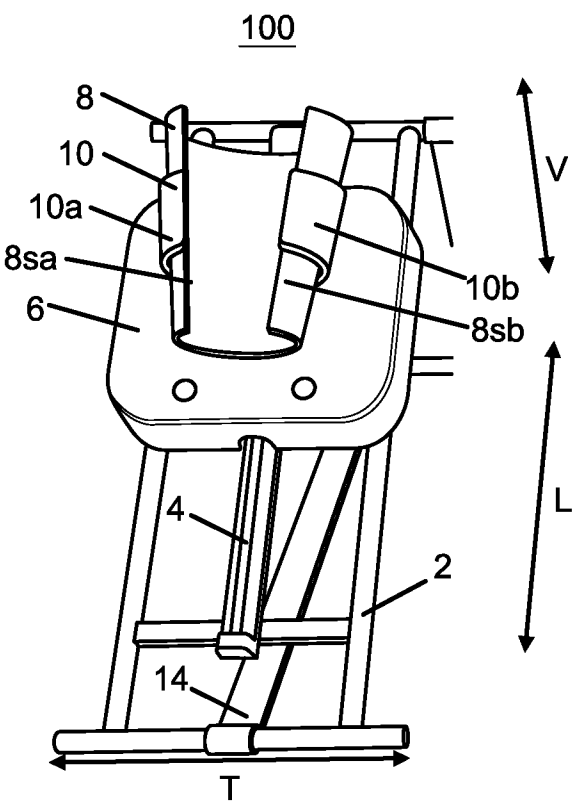
FIG. 6A
FIG. 6

DRESSING ASSISTANCE DEVICE AND DRESSING ASSISTANCE METHOD

FIELD

The present disclosure relates to dressing assistance techniques. More particularly, the present disclosure relates to a dressing assistance device and a dressing assistance method for aiding users in donning and removing garments.

BACKGROUND

Some individuals may experience difficulty when putting on and taking off garments, such as those suffering from arthritis, cerebral palsy, muscular dystrophy, or individuals recovering from surgeries like knee or hip replacements. Further, individuals that have circulatory disorders are sometimes challenged in putting on tight-fitting compression socks or sleeves which are designed to reduce pooling of fluids in the person's limbs. In certain cases, such individuals may be unable to bend down, lean forward, or may lack sufficient flexibility and strength in their hands or legs to don or remove garments. Conventionally, various devices exist that have been designed to assist individuals with limited or restricted physical capabilities in dressing and undressing. However, these known devices often rely on manually operated tools that still require a certain level of flexibility from the user. Accordingly, there is a need for a dressing assistance technique for aiding limited-mobility individuals in donning and removing garments such as socks, stockings, sleeves, or the like.

SUMMARY

Aspects of the disclosure relate to a dressing assistance device. The dressing assistance device may be configurable between a deployed state for assisting a user put on or remove a garment such as a sock, stocking (e.g., compression stocking), sleeve, or the like, and a stowable state for facilitating compact storage of the dressing assistance device. The dressing assistance device may include a motor for driving a garment mount section to which a garment is attached along a guide rail to pull the garment onto or off of a limb of the user. The motor may also be configured to adjust the width of the garment mount section to stretch the attached garment to accommodate the limb of the user. According to the embodiments of the present disclosure, it is possible to provide a dressing assistance device capable of facilitating garment donning and removal while maintaining a compact, easily-storable form factor.

According to an aspect of the present disclosure, a dressing assistance device includes: a rest frame structure for supporting a limb of a user; a guide rail disposed along a longitudinal direction of the rest frame structure; a mount support section movably connected to the guide rail; a garment mount section operably coupled to the mount support section for receiving attachment of a garment; a mount adjustment section operably coupled to the mount support section and configured to adjust a width of the garment mount section; and a motor operably coupled to the mount support section and the mount adjustment section, wherein the motor is configured to: drive the mount support section to travel along the guide rail, and drive the mount adjustment section to adjust the garment mount section between a closed position for receiving attachment of a garment and an open position that allows for insertion and removal of the limb of the user.

According to an embodiment of any paragraph(s) of this summary, in the closed position, the garment mount section defines a hollow conical frustum having a first circumferential edge that defines a first opening at a first longitudinal end of the garment mount section and a second circumferential edge that defines a second opening at a second longitudinal end of the garment mount section; and the first opening has a first circumference greater than a second circumference of the second opening.

According to an embodiment of any paragraph(s) of this summary, the first circumference is less than or equal to 61 centimeters.

According to an embodiment of any paragraph(s) of this summary, the garment mount section is configured to receive attachment of a garment such that: a cuff of the garment is fitted over the first circumferential edge of the garment mount section; a body of the garment extends along the longitudinal direction within the hollow conical frustum of the garment mount section; and a garment opening of the garment is substantially concentric with the first opening of the garment mount section.

According to an embodiment of any paragraph(s) of this summary, the limb of the user is partially inserted into the garment opening of the garment fitted over the first circumferential edge of the garment mount section; and the motor drives the mount support section to travel along the guide rail toward the limb of the user, thereby fitting the garment onto the limb of the user.

According to an embodiment of any paragraph(s) of this summary, the mount adjustment section includes a clamp having: a first jaw portion configured to interface with a first surface of the garment mount section; a second jaw portion configured to interface with a second surface of the garment mount section that is opposite the first surface; and a mechanical actuator operably coupled to the first jaw portion, the second jaw portion, and the motor, and configured to use mechanical energy generated by the motor to apply force to the first jaw portion and the second jaw portion.

According to an embodiment of any paragraph(s) of this summary, the mechanical actuator is configured to: apply, using mechanical energy generated by the motor, force to the first jaw portion and the second jaw portion to push the first surface and the second surface of the garment mount section toward each other in a transverse direction perpendicular to the longitudinal direction to adjust the garment mount section to the closed position; and apply, using mechanical energy generated by the motor, force to the first jaw portion and the second jaw portion to pull the first surface and the second surface of the garment mount section apart from each other in the transverse direction of the dressing assistance device to adjust the garment mount section to the open position.

According to an embodiment of any paragraph(s) of this summary, a garment is attached to the garment mount section in the closed position such that adjusting the garment mount section from the closed position to the open position stretches a garment opening of the garment.

According to an embodiment of any paragraph(s) of this summary, the motor has an output torque characteristic that achieves a torque threshold sufficient for widening a garment opening of the garment attached to the garment mount section to a predetermined width.

According to an embodiment of any paragraph(s) of this summary, the rest frame structure includes: a longitudinal frame section having a first end portion and a second end portion; and a rotatable frame section coupled to the second end portion of the longitudinal frame section by a first set of hinges.

According to an embodiment of any paragraph(s) of this summary, the dressing assistance device further includes an elastic support strap extending between the rotatable frame section and the first end portion of the longitudinal frame section.

According to an embodiment of any paragraph(s) of this summary, the rest frame structure is configurable between a deployed state and a stowable state by rotating the rotatable frame section around the first set of hinges.

According to an embodiment of any paragraph(s) of this summary, in the deployed state, the rotatable frame section is rotated around the first set of hinges to extend in a vertical direction to support the second end portion of the longitudinal frame section at a designated height.

According to an embodiment of any paragraph(s) of this summary, the rotatable frame section includes a height adjustment section for adjusting a height of the second end portion of the longitudinal frame section in the deployed state According to an embodiment of any paragraph(s) of this summary, the height adjustment section is configured to adjust the height of the second end portion of the longitudinal frame section between 30 centimeters and 51 centimeters in the deployed state.

According to an embodiment of any paragraph(s) of this summary, in the stowable state, the rotatable frame section is rotated around the first set of hinges to extend in the longitudinal direction toward the first end portion of the longitudinal frame section.

According to an aspect of the present disclosure, a dressing assistance device includes: a rest frame structure for supporting a limb of a user; a guide rail disposed along a longitudinal direction of the rest frame structure; a mount support section movably connected to the guide rail; a garment mount section operably coupled to the mount support section for receiving attachment of a garment; and a mount adjustment section operably coupled to the mount support section and configured to adjust a width of the garment mount section, wherein: the rest frame structure includes: a longitudinal frame section having a first end portion and a second end portion, and a rotatable frame section coupled to the second end portion of the longitudinal frame section by a first set of hinges; the rest frame structure is configurable between a deployed state and a stowable state by rotating the rotatable frame section around the first set of hinges; in the deployed state, the rotatable frame section is rotated around the first set of hinges to extend in a vertical direction to support the second end portion of the longitudinal frame section at a designated height; and in the stowable state, the rotatable frame section is rotated around the first set of hinges to extend in the longitudinal direction toward the first end portion of the longitudinal frame section.

According to an embodiment of any paragraph(s) of this summary, the longitudinal frame section includes: a first transverse member and a second transverse member extending in a transverse direction perpendicular to the longitudinal direction; a first longitudinal member extending between the first transverse member and the second transverse member such that a first end of the first longitudinal member is coupled to the first transverse member and a second end of the first longitudinal member is coupled to the second transverse member; and a second longitudinal member extending between the first transverse member and the second transverse member such that a first end of the second longitudinal member is coupled to the first transverse member and a second end of the second longitudinal member is coupled to the second transverse member; and the rotatable frame section includes: a third transverse member extending in the transverse direction; a first erectable member extending between the second transverse member of the longitudinal frame section and the third transverse member such that a first end of the first erectable member is coupled to the second transverse member and a second end of the first erectable member is coupled to the third transverse member; and a second erectable member extending between the second transverse member of the longitudinal frame section and the third transverse member such that a first end of the second erectable member is coupled to the second transverse member and a second end of the second erectable member is coupled to the third transverse member.

In embodiments, an aspect of the present disclosure relates to dressing assistance method for use with a dressing assistance device, the dressing assistance device including: a rest frame structure for supporting a limb of a user; a guide rail disposed along a longitudinal direction of the rest frame structure; a mount support section movably connected to the guide rail; a garment mount section operably coupled to the mount support section for receiving attachment of a garment; a mount adjustment section operably coupled to the mount support section and configured to adjust a width of the garment mount section; and a motor operably coupled to the mount support section and the mount adjustment section, wherein the motor is configured to: drive the mount support section to travel along the guide rail, and drive the mount adjustment section to adjust the garment mount section between a closed position for receiving attachment of a garment and an open position that allows for insertion and removal of the limb of the user, the dressing assistance method including: fitting a garment onto the garment mount section while the garment mount section is configured in the closed position; driving the mount adjustment section with the motor to adjust the garment mount section to the open position to stretch a garment opening of the garment; receiving insertion of a limb of the user into a garment opening of the garment; and driving the mount support section with the motor to travel along the guide rail toward the limb of the user from a predetermined starting position to a predetermined stopping position, thereby fitting the garment onto the limb of the user.

According to an embodiment of any paragraph(s) of this summary, the dressing assistance method further includes: receiving insertion of a limb of the user in the garment mount section; fitting a portion of a garment worn on the limb of the user onto the garment mount section; and driving the mount support section with the motor to travel along the guide rail away from the user from a predetermined starting position to a predetermined stopping position, thereby removing the garment from the limb of the user.

According to an embodiment of any paragraph(s) of this summary, driving the mount support section and driving the mount adjustment section with the motor are performed in response to commands received from a remote control device communicably connected to the motor.

The above summary is not intended to describe each illustrated embodiment or every implementation of the present disclosure.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

FIG. 6 illustrates additional perspective views of a dressing assistance device in which a mount adjustment section has been configured in an open position, according to the embodiments of the present disclosure.

DETAILED DESCRIPTION

Figure 1:
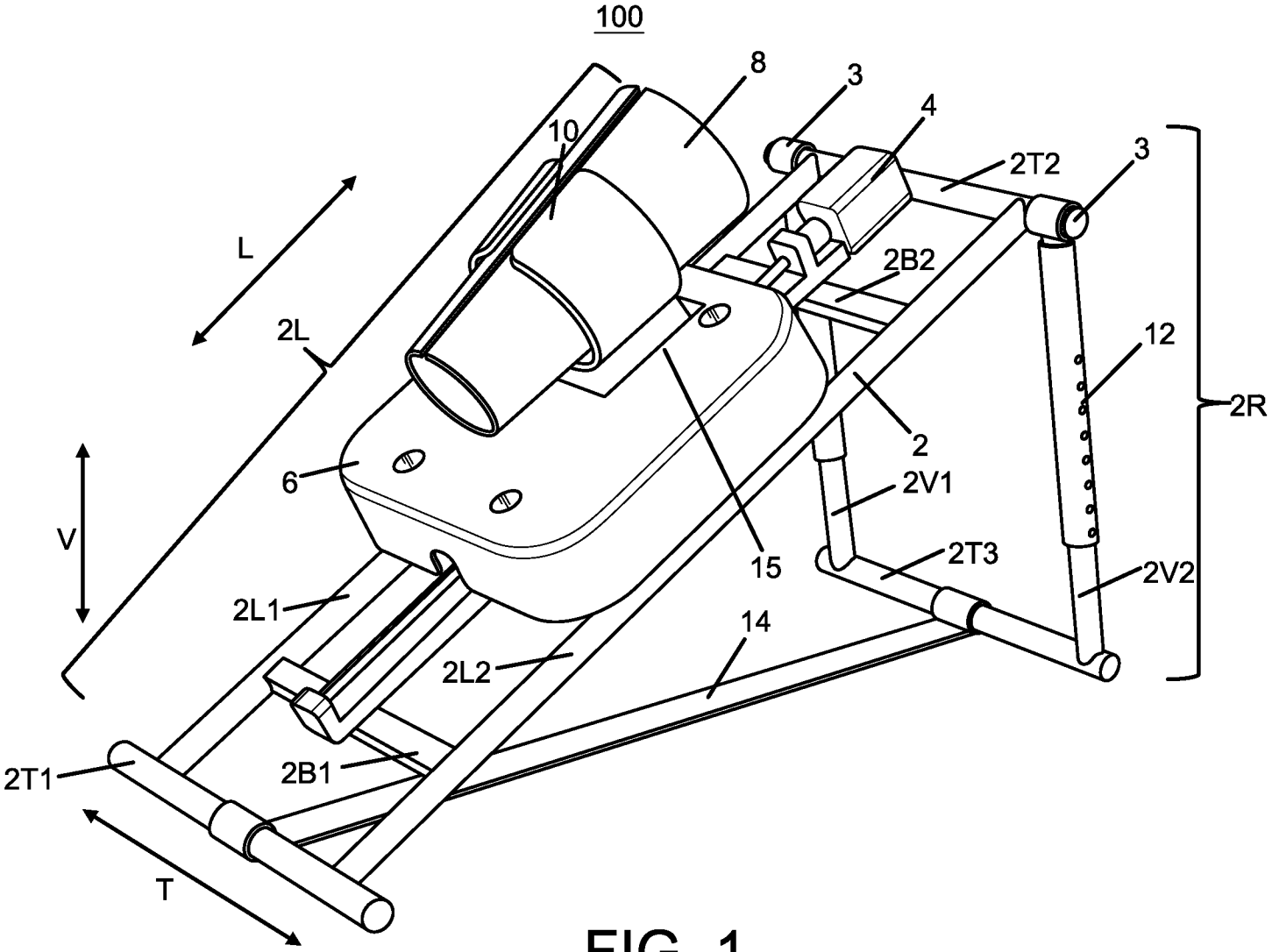
FIG. 1 illustrates a perspective view of a dressing assistance device in a deployed state when viewed obliquely from the front, according to the embodiments of the present disclosure.

Hereinafter, embodiments of the present disclosure will be described with reference to the accompanying drawings. It should be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure. Additionally, it should be noted in the following description that the same reference numerals in different embodiments denote the same or similar features.

Turning now to the figures, FIGS. 1-6 illustrate various views of a dressing assistance device 100 according to the embodiments of the present disclosure. Herein, for convenience of description, elements present in multiple views will be collectively described with reference to the figures.

With regard to directions, herein, aspects of the disclosure will be described with reference to directions defined with reference to the dressing assistance device 100. As illustrated in FIGS. 1-6, a direction parallel to the longitudinal axis of the dressing assistance device 100 is referred to as the longitudinal direction L, a direction parallel to a transverse axis of the dressing assistance device 100 is referred to as the transverse direction T, and the height direction of the dressing assistance device 100 (e.g., a direction perpendicular to the plane of the floor on which the dressing assistance device 100 rests) is referred to as the vertical direction V.

Figure 2:
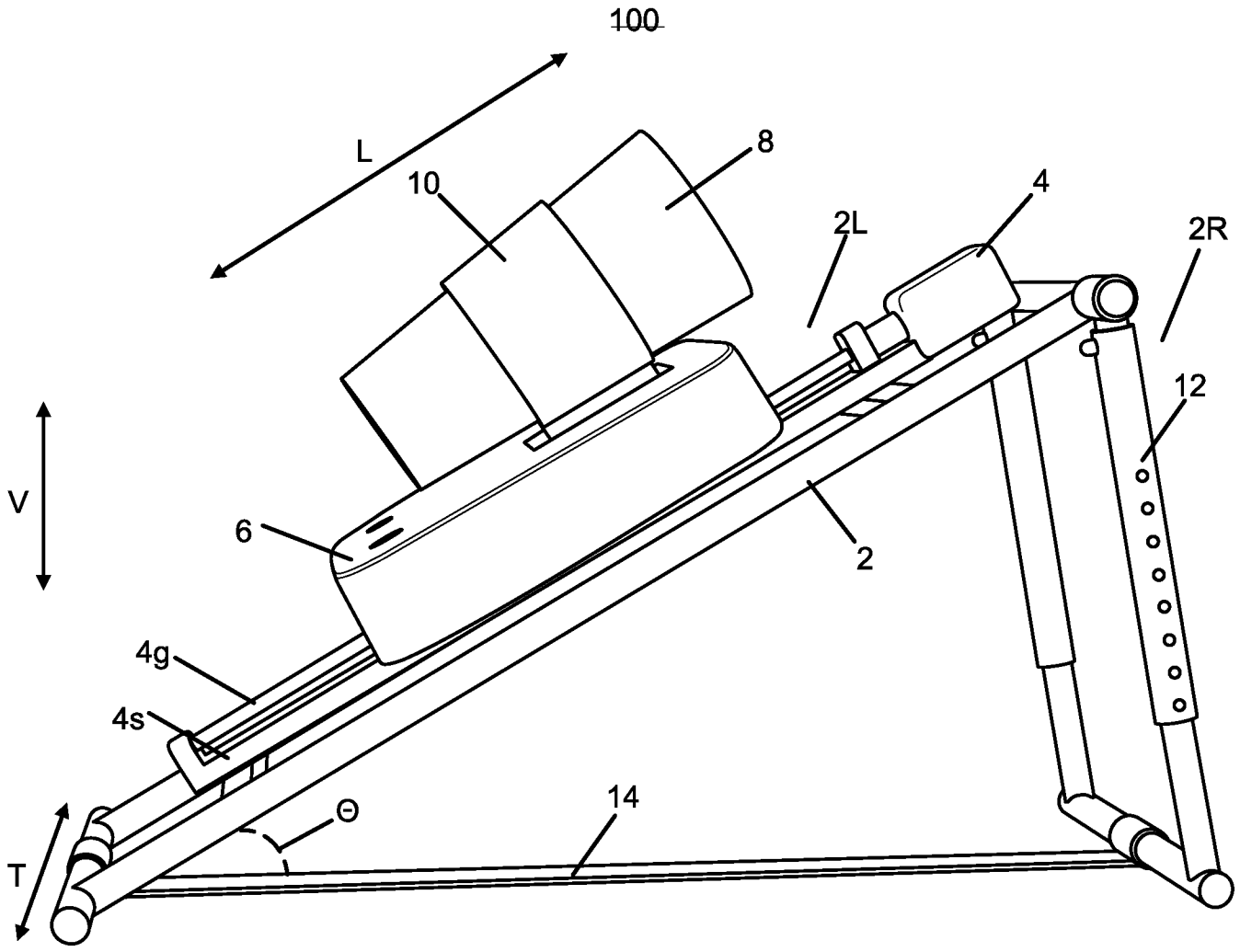
FIG. 2 illustrates an additional perspective view of a dressing assistance device in a deployed state when viewed from the side, according to the embodiments of the present disclosure.
Figure 3:
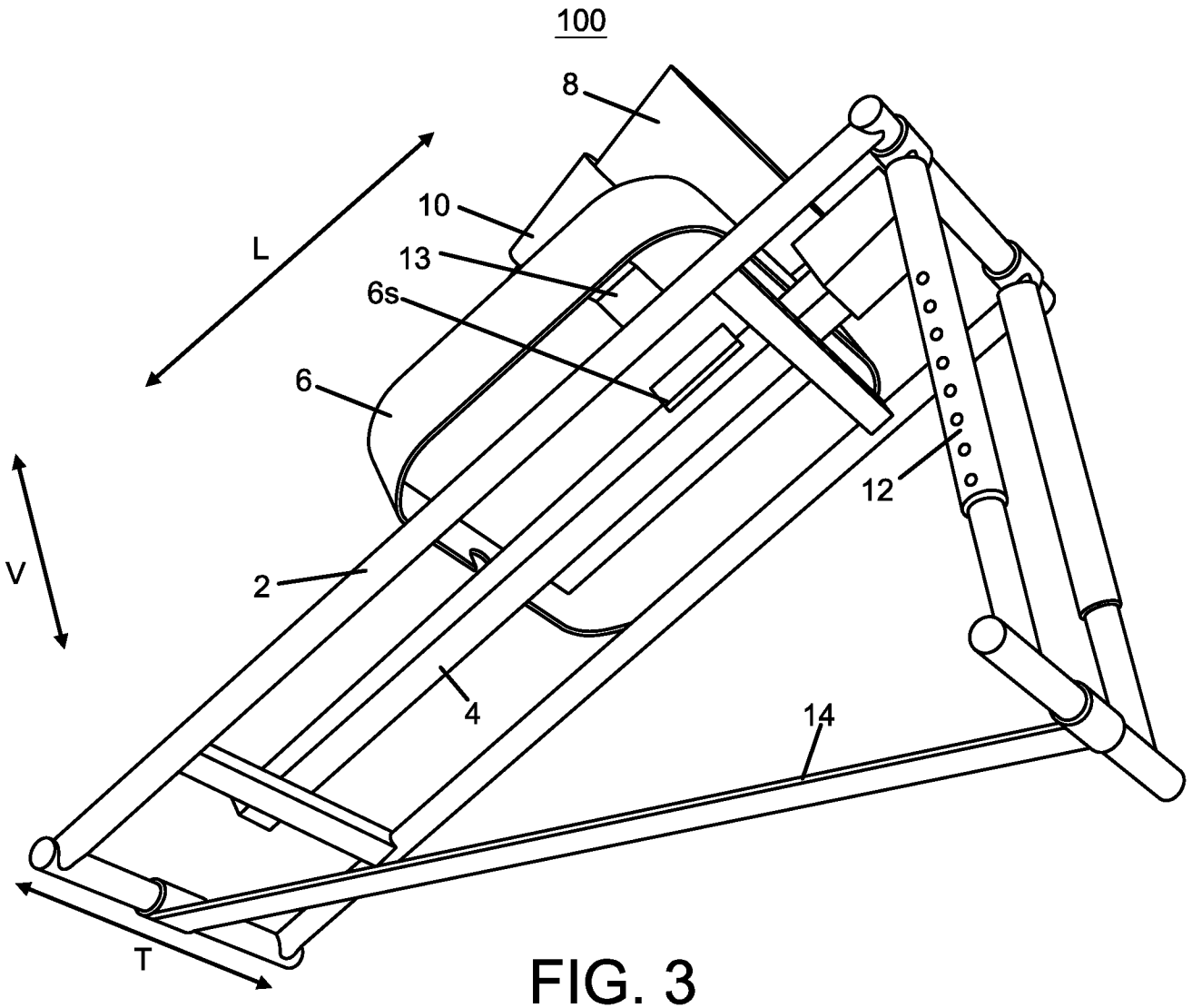
FIG. 3 illustrates an additional perspective view of a dressing assistance device in a deployed state when viewed obliquely from below, according to the embodiments of the present disclosure.
Figure 4:
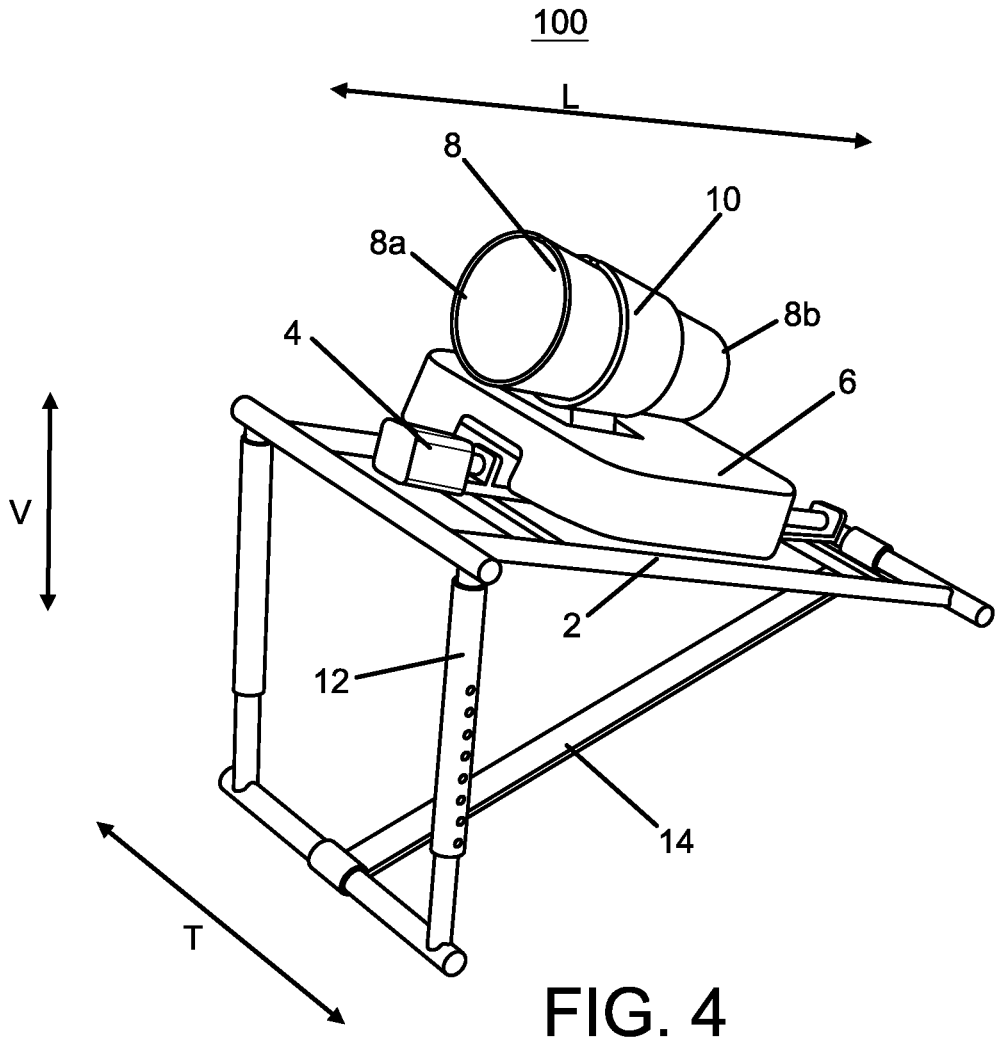
FIG. 4 illustrates an additional perspective view of a dressing assistance device in a deployed state when viewed obliquely from the rear, according to the embodiments of the present disclosure.

FIG. 1 illustrates a perspective view of a dressing assistance device 100 in a deployed state when viewed obliquely from the front. FIG. 2 illustrates an additional perspective view of the dressing assistance device in a deployed state when viewed from the side. FIG. 3 illustrates an additional perspective view of the dressing assistance device 100 in a deployed state when viewed obliquely from below. FIG. 4 illustrates an additional perspective view of a dressing assistance device 100 in a deployed state when viewed obliquely from the rear.

As illustrated in at least FIGS. 1-4, the dressing assistance device 100 according to the embodiments of the present disclosure primarily includes a rest frame structure 2, a guide rail 4 disposed along a longitudinal axis of the rest frame structure 2, a mount support section 6 movably connected to the guide rail 4, a garment mount section 8 operably coupled to the mount support section 6 for receiving attachment of a garment, a mount adjustment section 10 operably coupled to the mount support section 6 and configured to adjust a width of the garment mount section 8, a height adjustment section 12 constituting a portion of the rest frame structure 2, a motor 13 (illustrated in FIG. 3) configured to drive movement of the mount support section 6 and the mount adjustment section 10, and a support strap 14 extending between end portions of the rest frame structure 2.

In embodiments, the rest frame structure 2 may include an assembly formed from a plurality of pipes, poles, or tubes to provide a frame for supporting the other components of the dressing assistance device 100. As described herein, the rest frame structure 2 may serve as the framework on which the guide rail 4, the mount support section 6, the garment mount section 8, and the mount adjustment section 10 are mounted. The pipes constituting the rest frame structure 2 may be hollow or solid, and may be constructed from materials such as metal (e.g., aluminum), plastic, or other suitable material capable of providing a lightweight, durable form factor. The rest frame structure 2 may be configured to support the weight of the components described above as well as the weight of a limb 22 (e.g., arm, leg, illustrated in FIG. 7) of a user.

As illustrated in FIG. 1, in embodiments, the rest frame structure 2 may include a longitudinal frame section 2L having a first end portion and a second end portion, and a rotatable frame section 2R coupled to the second end portion of the longitudinal frame section by a first set of hinges 3.

More particularly, as illustrated in FIG. 1, the longitudinal frame section 2L may include a first longitudinal member 2L1 and a second longitudinal member 2L2 extending in the longitudinal direction L, a first transverse member 2T1 and a second transverse member 2T2 extending in the transverse direction T, and a first brace member 2B1 and a second brace member 2B2 extending in the transverse direction T. The rotatable frame section 2R may include a third transverse member 2T3 extending in the transverse direction T and a first erectable member 2V1 and a second erectable member 2V2 extending perpendicularly from the third transverse member 2T3. The first transverse member 2T1 and the third transverse member 2T3 may rest on a surface (e.g., the ground, a floor) when the dressing assistance device 100 is configured in a deployed state. The various members constituting the rest frame structure 2 may be integrally molded together or coupled with a variety of fasteners including nuts, screws, bolts, latches, clamps, hinges, or the like. In certain embodiments, the rest frame structure 2 may have a length in the longitudinal direction L of 61 centimeters (24 inches), a width in the transverse direction T of 20 centimeters (8 inches), and an adjustable height of between 30 to 50 centimeters (12 to 20 inches) in the deployed state, but the dimensions of the rest frame structure 2 are not particularly limited herein, and may be freely set based on the desired specifications of the manufacturer.

First ends of the first longitudinal member 2L1 and the second longitudinal member 2L2 may be coupled to the first transverse member 2T1, and second ends of the first longitudinal member 2L1 and the second longitudinal member 2L2 may be coupled to the second transverse member 2T2 such that the first longitudinal member 2L1 and the second longitudinal member 2L2 extend substantially parallel to one another in the longitudinal direction L between the first transverse member 2T1 and the second transverse member 2T2. The first and second longitudinal members 2L1, 2L2 may be oriented so as to be substantially perpendicular with respect to the first and second transverse members 2T1, 2T2. The locations at which the first longitudinal member 2L1 and the second longitudinal member 2L2 are coupled to the first transverse member 2T1 and the second transverse member 2T2 are not particularly limited herein, but in embodiments, the first longitudinal member 2L1 and the second longitudinal member 2L2 may be coupled at locations within 25% of the respective lengths of the first transverse member 2T1 and the second transverse member 2T2 from the respective endpoints thereof.

First ends of the first brace member 2B1 and the second brace member 2B2 may be coupled to the first longitudinal member 2L1, and second ends of the first brace member 2B1 and the second brace member 2B2 may be coupled to the second longitudinal member 2L2 such that the first brace member 2B1 and the second brace member 2B2 extend substantially parallel to one another and to the first and second transverse members 2T1, 2T2 in the transverse direction T between the first longitudinal member 2L1 and the second longitudinal member 2L2. The first and second brace members 2B1, 2B2 may be oriented so as to be substantially perpendicular with respect to the first and second longitudinal members 2L1, 2L2. The locations at which the first brace member 2B1 and the second brace member 2B2 are coupled to the first longitudinal member 2L1 and the second longitudinal member 2L2 are not particularly limited herein, but in embodiments, the first brace member 2B1 and the second brace member 2B2 may be coupled at locations within 25% of the respective lengths of the first longitudinal member 2L1 and the second longitudinal member 2L2 from the respective endpoints thereof. In this way, stability of the rest frame structure 2 can be facilitated while providing support for the guide rail 4, the mount support section 6, the garment mount section 8, and the mount adjustment section 10.

First ends of the first erectable member 2V1 and the second erectable member 2V2 may be coupled to the second transverse member 2T2, and second ends of the first erectable member 2V1 and the second erectable member 2V2 may be coupled to the third transverse member 2T3 such that the first erectable member 2V1 and the second erectable member 2V2 extend substantially parallel to one another between the second transverse member 2T2 and the third transverse member 2T3. The first and second erectable members 2V1, 2V2 may be oriented so as to be substantially perpendicular with respect to the first and second transverse members 2T1, 2T2. The first ends of the first erectable member 2V1 and the second erectable member 2V2 may be coupled to the second transverse member 2T2 using a first set of hinges 3 that allow the first and second erectable members 2V1, 2V2 to rotate about the second transverse member 2T2 between a deployed state and a stowable state, described later herein. The first and second erectable members 2V1, 2V2 may support the second transverse member 2T2 at a designated height in the vertical direction V above the third transverse member 2T3 in the deployed state.

In embodiments, the first and second erectable members 2V1, 2V2 of the rotatable frame section 2R may include a height adjustment section 12 configured to adjust the height of the second transverse member 2T2 in the vertical direction V in the deployed state. The height adjustment section 12 may include a telescopic height adjustment mechanism that includes outer tubular sections into which the first and second erectable members 2V1, 2V2 are inserted. The outer tubular sections may have a circumference greater than the circumference of the first and second erectable members 2V1, 2V2, such that the first and second erectable members 2V1, 2V2 fit snugly therein. One or both of the outer tubular sections may be equipped with a series of notches along their length, which serve as designated stopping points for a spring-loaded button integrated into one or both of the first and second erectable members 2V1, 2V2. When the button is pressed, the spring compresses, allowing the first and second erectable members 2V1, 2V2 to move freely within the respective outer tubular sections into which they are inserted and allowing extension or retraction of the effective length of the first and second erectable members 2V1, 2V2. When configured in the deployed state, extension or retraction of the length of the first and second erectable members 2V1, 2V2 allows for the height of the second transverse member 2T2 in the vertical direction V to be adjusted. When the spring-loaded button is released, it engages with one of the notches in the outer tubular section, securing the height adjustment section 12 at a particular height. In this way, the height of the second transverse member 2T2 in the vertical direction V can be freely adjusted to facilitate donning or removal of a garment 24 (illustrated in FIG. 7) by a user of the dressing assistance device 100.

As described herein, in embodiments, the height adjustment section 12 may allow the dressing assistance device 100 to be adjusted between a height of 30 to 50 centimeters (12 to 20 inches) in the vertical direction V in the deployed state. As will be understood by the illustration of FIG. 2, adjustment of the height of the dressing assistance device 100 using the height adjustment section 12 changes the angle Θ between the horizontal plane of the floor and the longitudinal plane of the longitudinal frame section 2L. It should be noted that while the range of the angle Θ is not particularly limited herein, in embodiments, the angle may vary between 25 degrees and 50 degrees based on the height set by the height adjustment section 12 (e.g., 29 degrees at a height of 12 inches, 49 degrees at a height of 20 inches). In this way, by adjusting the height of the dressing assistance device 100 and the angle Θ between the horizontal plane of the floor and the longitudinal plane of the rest frame structure 2 using the height adjustment section 12, it is possible to facilitate garment donning and removal for users in a range of positions. As an example, in the case that the user is seated on a surface such as a bed that is taller than the dressing assistance device 100, the height adjustment section 12 may be used to increase the height of the dressing assistance device 100 and the angle Θ to allow for the user to easily slide their foot and leg into the garment mount section 8. Conversely, in the case that the user is seated on a lower surface such as a chair, the height adjustment section 12 may be used to decrease the height of the dressing assistance device 100 and the angle Θ. As another example, by placing the dressing assistance device 100 on a table and adjusting the height adjustment section 12, it is possible to facilitate putting on and removing garments (e.g., compression sleeves, gloves) from upper extremities such as the hands and arms.

As illustrated in at least FIGS. 1-4, the dressing assistance device 100 may include a support strap 14. The support strap 14 may include a flexible cord, cable, rope or strip of fabric formed from an elastic material such as nylon, rubber, or the like. The support strap 14 may be fastened at a first end to the first transverse member 2T1 and fastened at a second end to the third transverse member 2T3 illustrated in FIG. 1. In embodiments, each end of the support strap 14 may be provided with a loop for facilitating attachment to the first and third transverse members 2T1, 2T3. The support strap 14 preferably has a tensile elasticity resistance sufficient to maintain an acute angle between the longitudinal frame section 2L and the rotatable frame section 2R under the weight of a limb 22 (illustrated in FIG. 7) of the user. By providing the support strap 14 fastened to the first and third transverse members 2T1, 2T3, it is possible to prevent the third transverse member 2T3 from pivoting to an obtuse angle with respect to the first and second longitudinal members 2L1, 2L2 under the weight of the limb 22 of a user, and thereby facilitate stability of the rest frame structure 2 in the deployed state.

As described herein, in embodiments, the first ends of the first erectable member 2V1 and the second erectable member 2V2 of the rotatable frame section 2R may be coupled to the second transverse member 2T2 of the longitudinal frame section 2L using a first set of hinges 3, as illustrated in FIG. 1. The first set of hinges 3 may allow for the rotatable frame section 2R to rotate with respect to the longitudinal frame section 2L between a deployed state (illustrated in FIGS. 1-4, 6) and a stowable state (illustrated in FIG. 5). With reference to FIG. 1, the deployed state may refer to a standing configuration in which the first and second erectable members 2V1, 2V2 of the rotatable frame section 2R have been rotated around the first set of hinges 3 to extend from the third transverse member 2T3 in the vertical direction V substantially perpendicular with respect to the horizontal plane of the floor to support the second transverse member 2T2 at a designated height set by the height adjustment section 12. The deployed state may be used to facilitate donning of a garment 24 (illustrated in FIG. 7) such as a sock or stocking by a user of the dressing assistance device 100.

Figure 5:
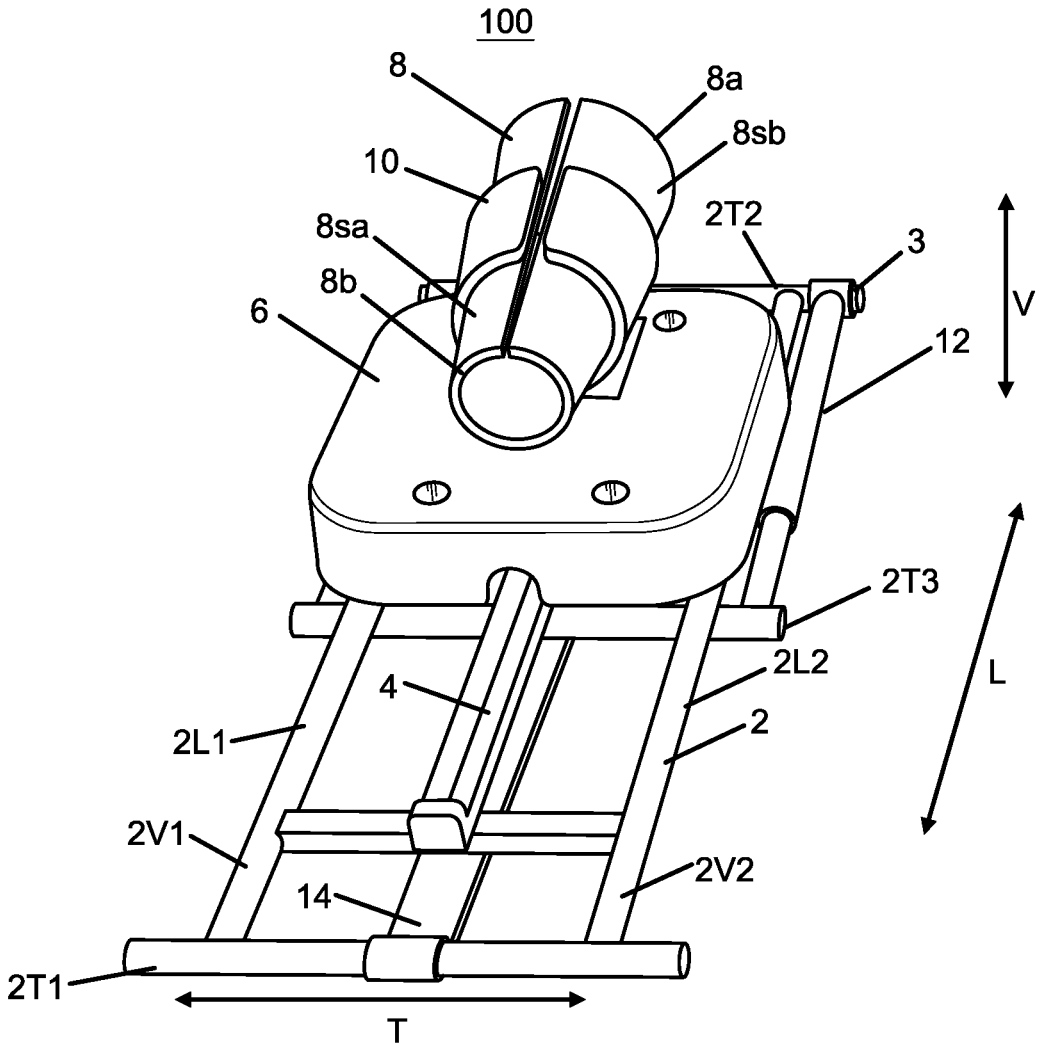
FIG. 5 illustrates an additional perspective view of a dressing assistance device in a stowable state when viewed obliquely from the front, according to the embodiments of the present disclosure.

FIG. 5 illustrates an additional perspective view of the dressing assistance device 100 in a stowable state when viewed obliquely from the front. With reference to FIG. 5, the stowable state may refer to a collapsed configuration in which the first and second erectable members 2V1, 2V2 of the rotatable frame section 2R have been rotated around the first set of hinges 3 toward the first transverse member 2T1 (e.g., the first end portion of the longitudinal frame section 2L) to extend parallel to the first and second longitudinal members 2L1, 2L2 in the longitudinal direction L. In the stowable state, as the first and second erectable members 2V1, 2V2 have been folded to extend in the longitudinal direction L rather than the vertical direction V, the height of the dressing assistance device 100 in the vertical direction V can be significantly reduced. Accordingly, the stowable state may be used to facilitate storage of the dressing assistance device 100. In embodiments, in the stowable state, the dressing assistance device 100 may be stored in a closet, under a bed, or suspended from a wall hook.

In embodiments, with reference to FIGS. 1-6, the guide rail 4 may include an elongated bar, rod, or other member for supporting and guiding movement of the mount support section 6. As illustrated in FIG. 1, the guide rail 4 may have a first end coupled to the first brace member 2B1 of the longitudinal frame section 2L and a second end coupled to the second brace member 2B2 of the longitudinal frame section 2L such that the guide rail 4 extends between the first brace member 2B1 and the second brace member 2B2. As illustrated in FIG. 2, in certain embodiments, the guide rail 4 may include a support rail 4*s* for supporting the weight of the mount support section 6 and a guide rod 4*g* for guiding movement of the mount support section 6. By means of the guide rail 4, it is possible to guide movement of the mount support section 6 along the longitudinal direction L of the dressing assistance device 100 to facilitate donning of a garment 24 (illustrated in FIG. 7).

In embodiments, with reference to FIGS. 1-7, the mount support section 6 may include a housing or enclosure for supporting the garment mount section 8 and the mount adjustment section 10. The mount support section 6 may be constructed from materials such as plastic, fiberglass, metal (e.g., aluminum), or other suitable material capable of providing a lightweight, durable form factor. As described herein, the mount support section 6 may be movably connected to the guide rail 4. Accordingly, the mount support section 6 may serve as a cart for moving the garment mount section 8, the mount adjustment section 10, and a garment 24 fitted to the garment mount section 8 along the guide rail 4. In embodiments, the mount support section 6 may include a motor 13 (illustrated in FIG. 3) for driving movement of the mount support section 6 and the mount adjustment section 10. By means of the mount support section 6, it is possible to support the garment mount section 8 and the mount adjustment section 10 in a movable configuration to facilitate the donning and removal of a garment 24.

Figure 7:
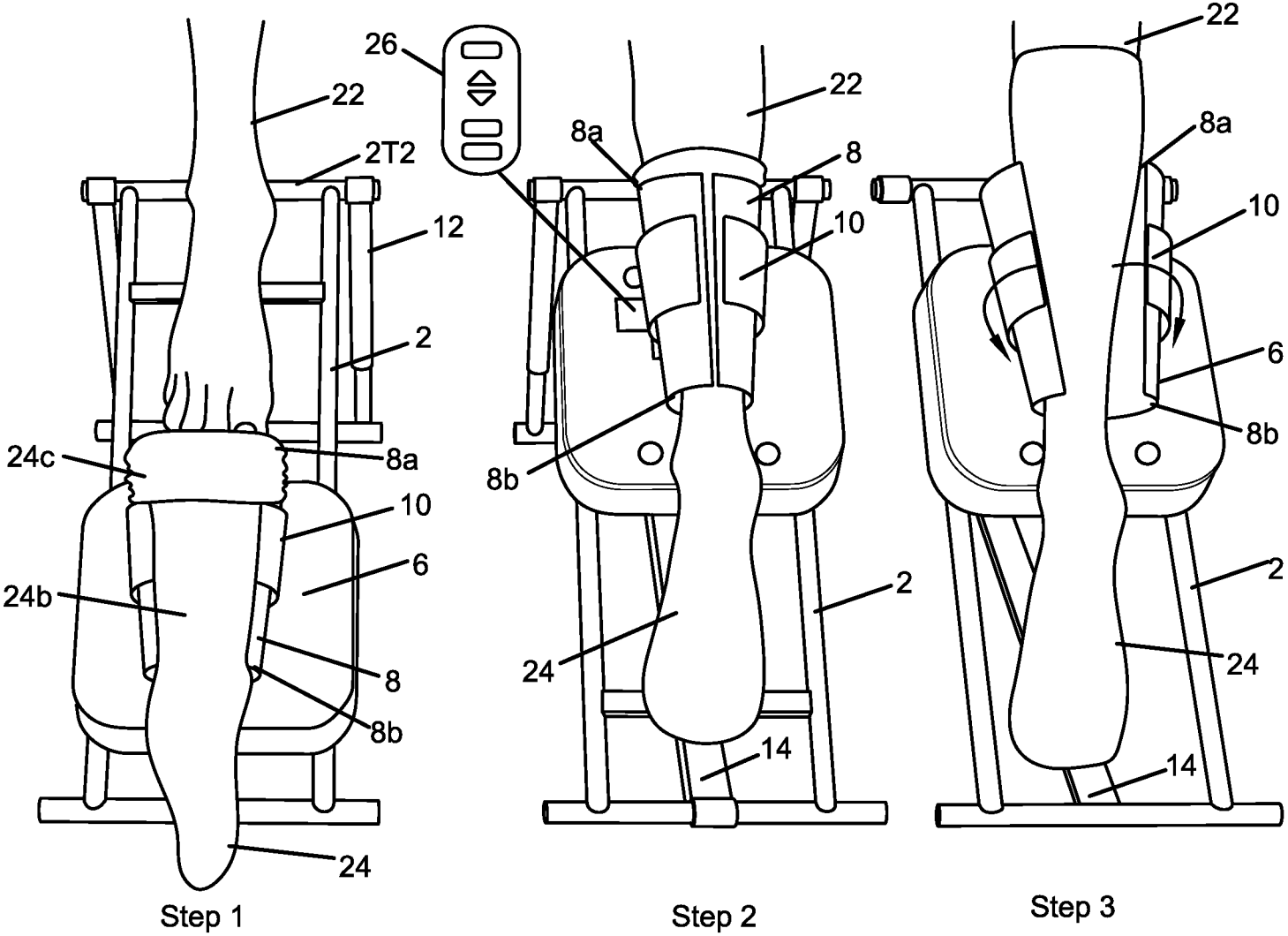
FIG. 7 illustrates a dressing assistance method using the dressing assistance device according to the embodiments of the present disclosure.

In embodiments, with reference to FIGS. 1-7, the garment mount section 8 may include a frame, casing, or other structure for receiving attachment of a garment 24 (illustrated in FIG. 7). The garment mount section 8 may be configured to accommodate a limb 22 (illustrated in FIG. 7) of a user on which the garment 24 will be worn. As described herein, the garment mount section 8 may be configurable in a closed position for receiving attachment of a garment and an open position that allows for insertion and removal of the limb 22 of the user. In embodiments, the garment mount section 8 may be a plastic member molded in a hollow, substantially conical shape with an opening or slit along its longitudinal axis. The garment mount section 8 may be pliable to allow elastic deformation in the transverse direction and facilitate adjustment to the open position and the closed position.

In embodiments, as illustrated in FIGS. 4-5, 7, when configured in the closed position, the garment mount section 8 may have the shape of a hollow conical frustum having a first circumferential edge 8*a* that defines a first opening at a first longitudinal end of the garment mount section 8 and a second circumferential edge 8*b* that defines a second opening at a second longitudinal end of the garment mount section 8. The first opening defined by the first circumferential edge 8*a* may have a first circumference greater than a second circumference of the second opening defined by the second circumferential edge 8*b*. In certain embodiments, the first circumference may be less than or equal to 61 centimeters (24 inches). By having the shape of a conical frustum as described herein, it is possible to accommodate and facilitate garment donning and removal for limbs that are thicker at a base end than a distal end (e.g., legs thicker at the thigh than the ankle).

In embodiments, as illustrated in FIG. 7, when donning a garment, the garment mount section 8 may be configured to receive attachment of a garment 24 such that a cuff 24*c* of the garment 24 is fitted over the first circumferential edge 8*a* of the garment mount section 8. The cuff 24*c* of the garment 24 may be rolled up or bunched together such that a larger portion of the garment 24 is fitted over the first circumferential edge 8*a* of the garment mount section 8, thereby securing the garment 24 to the garment mount section 8 to prevent slippage. The body 24*b* of the garment 24 may extend along the longitudinal direction L within the hollow conical frustum of the garment mount section 8 such that a garment opening (e.g., aperture for insertion of a limb) is substantially concentric with the first opening of the garment mount section 8. Alternatively, when removing a garment, the limb of the user may be inserted through the garment mount section 8 and a portion of the garment 24 may be fitted over the second circumferential edge 8*b* of the garment mount section 8.

With reference to FIGS. 1-7, the mount adjustment section 10 may include a bracket, brace, vise, or clamp operably coupled to the mount support section 6 configured to adjust a width of the garment mount section 8. Here, the width refers to the dimension of the garment mount section 8 in the transverse direction. The mount adjustment section 10 may be configured to apply force to the garment mount section 8 to adjust the garment mount section 8 between a closed position for receiving attachment of a garment 24 and an open position that allows for insertion and removal of the limb 22 (illustrated in FIG. 7) of the user. In embodiments, as illustrated in FIG. 6, the mount adjustment section 10 may be a clamp having a first jaw portion 10*a* configured to interface with a first surface 8*sa* of the garment mount section 8, a second jaw portion 10*b* configured to interface with a second surface 8*sb* of the garment mount section 8, and a mechanical actuator 15 (illustrated in FIG. 1) operably coupled to the first jaw portion 10*a*, the second jaw portion 10*b*, and the motor 13 (illustrated in FIG. 3).

In embodiments, with reference to FIG. 3, the motor 13 may include an electric motor operably coupled to the mount support section 6 and the mount adjustment section 10. In embodiments, the motor 13 may be housed within (e.g., on the underside of) the mount adjustment section 10. In certain embodiments, the motor 13 may be configured to receive power via a set of power cables connected to a nearby wall outlet. More particularly, a first power cable may be connected to a power unit provided on the rest frame structure 2 (e.g., under the second brace member 2B2 or at an end of the guide rail 4), and a second power cable may be connected to the power unit and the motor 13. The power unit may include a power distribution unit, power supply unit, power relay unit, power junction box, power inverter, or the like. Power from the wall outlet may be carried by the first power cable to the power unit, and subsequently provided from the power unit to the motor 13 via the second power cable. Alternatively, in other embodiments, the motor 13 may include a battery configured to charge at the power unit. In this case, the motor 13 may drive movement of the mount support section 6 and the mount adjustment section 10 without the need for the second power cable. In this way, by providing power to the motor 13 using two power cables connected via a power unit (or alternatively one power cable and a battery), it is possible to prevent the mount support section 6 from pulling the first power cable as it moves along the guide rail 4, and limit the tension in the first power cable. In certain embodiments, the motor 13 may be implemented using two or more motors. For instance, a first motor (e.g., provided at an end of the guide rail 4 or within the mount support section 6) may be configured to drive movement of the mount support section 6, and a second motor (e.g., attached to the mount adjustment section 10 or within the mount support section 6) may be configured to adjust the garment mount section 8 between the closed position and the open position.

The motor 13 may be configured to both drive the mount support section 6 to travel along the guide rail 4 and drive the mount adjustment section 10 to adjust the garment mount section 8 between the closed position for receiving attachment of the garment 24 and the open position for allowing insertion and removal of the limb 22 (illustrated in FIG. 7) of the user. More particularly, with regard to driving movement of the mount support section 6, as illustrated in FIG. 3, the motor 13 may be connected to a linear actuator 6*s* disposed on the underside of the mount support section 6 for converting mechanical energy from the motor 13 into linear motion for moving the mount support section 6 along the guide rail 4. In certain embodiments, the linear actuator 6*s* may include a winch coupled to a slide block. The slide block may engage with the guide rail 4 via ball bearings or the like. The mechanical energy from the motor 13 may wind or release a cable from a motor-driven spool of the winch to provide the pulling or pushing force for driving the linear motion of the slide block to slide along the guide rail 4. In certain embodiments, the linear actuator 6*s* may include a belt-driven actuator or the like. By means of the motor 13 and the linear actuator 6*s*, it is possible to allow the mount support section 6 to slide along the guide rail 4 in the longitudinal direction L.

As described herein, with regard to driving movement of the mount adjustment section 10, as illustrated in FIG. 1, the motor 13 may be connected to a mechanical actuator 15. The motor 13 may generate and supply mechanical energy to the mechanical actuator 15 of the mount adjustment section 10. The mechanical actuator 15 may include a threaded rod and gearing, hydraulic mechanism, or the like for translating mechanical energy from the motor 13 into force for pushing or pulling the first jaw portion 10*a* and the second jaw portion 10*b*. That is, the mechanical actuator 15 may be configured to use the mechanical energy generated by the motor 13 to apply force to the first jaw portion 10*a* and the second jaw portion 10*b*. The force applied to the first jaw portion 10*a* and the second jaw portion 10*b* may adjust the garment mount section 8 between the closed position for receiving attachment of a garment 24 and the open position that allows for insertion and removal of the limb 22 of the user.

More particularly, the mechanical actuator 15 may use the mechanical energy generated by the motor 13 to apply force to the first jaw portion 10*a* and the second jaw portion 10*b* to push the first surface 8*sa* and the second surface 8*sb* of the garment mount section 8 toward each other in the transverse direction T, thereby adjusting the garment mount section 8 to the closed position (e.g., reducing the width of the garment mount section 8 and the distance between the first and second surfaces 8*sa*, 8*sb*). Conversely, the mechanical actuator 15 may use the mechanical energy generated by the motor 13 to apply force to the first jaw portion 10*a* and the second jaw portion 10*b* to pull the first surface 8*sa* and the second surface 8*sb* of the garment mount section 8 apart from each other in the transverse direction T, thereby adjusting the garment mount section 8 to the open position (e.g., increasing the width of the garment mount section 8 and the distance between the first and second surfaces 8*sa*, 8*sb*). In embodiments, the first jaw portion 10*a* and the second jaw portion 10*b* may include a locking mechanism to lock in place in the closed position or the open position.

As described previously herein, FIGS. 1-5, 7 illustrate the closed position of the garment mount section 8. As used herein, the closed position refers to a position in which the first surface 8*sa* and the second surface 8*sb* of the garment mount section 8 are separated from each other by a distance less than a predetermined threshold distance (e.g., 1 inch, 3 inches, 5 inches). As shown in FIG. 5, when configured in the closed position, the first surface 8*sa* and the second surface 8*sb* of the garment mount section 8 are pushed together to approach each other in the transverse direction T, forming a hollow conical frustum, as described above. The closed position of the garment mount section 8 may be used to facilitate attachment of the garment 24, and also secure the garment mount section 8 around the limb 22 of the user.

FIG. 6 illustrates additional perspective views of the dressing assistance device 100 when the garment mount section 8 has been configured in the open position. As used herein, the open position refers to a position in which the first surface 8*sa* and the second surface 8*sb* of the garment mount section 8 are separated from each other by a distance greater than a predetermined threshold distance (e.g., 1 inch, 3 inches, 5 inches). More particularly, FIGS. 6A, 6B illustrate perspective views of the dressing assistance device 100 with the garment mount section 8 in the open position when viewed obliquely from the front. As shown in FIGS. 6A, 6B, when configured in the open position, the first surface 8*sa* and the second surface 8*sb* of the garment mount section 8 are pulled apart from each other in the transverse direction T to create a gap therebetween. By attaching a garment 24 to the garment mount section 8 in the closed position illustrated in FIGS. 1-5, 7, and using the motor 13 to drive the mechanical actuator 15 to pull the first surface 8*sa* and the second surface 8*sb* of the garment mount section 8 apart from each other in the transverse direction T, it is possible to stretch the garment opening of the garment 24. This can be particularly advantageous for stretching garments like compression socks having a high tensile elasticity resistance, which may prove challenging for limited-mobility users to stretch manually. In embodiments, the motor 13 may have an output torque characteristic that achieves a torque threshold sufficient for widening the garment opening of the garment 24 to a predetermined width. The torque characteristic of the motor 13 and the desired width of the garment opening may be suitably selected in consideration of the garments envisioned to be used in conjunction with the dressing assistance device 100.

It should be noted that herein, for convenience of explanation, while reference is made to the open position and the closed position of the garment mount section 8 and the deployed state and the stowable state of the rest frame structure 2, the dressing assistance device 100 according to the present disclosure is not limited to these configurations, and a variety of intermediate configurations (e.g., partially open positions between the open position and the closed position, partially folded states between the deployed state and the stowable state) are also contemplated.

FIG. 7 illustrates a dressing assistance method using the dressing assistance device 100 according to the embodiments of the present disclosure. The dressing assistance method described herein is a method for using the dressing assistance device 100 to put on or removing a desired garment 24. As described herein, the garment 24 may be a sock, stocking (e.g., compression stocking), sleeve (e.g., compression sleeve), tights, leggings, pant leg, shirt sleeve, hosiery, or other garment worn on the arms or the legs, and is not particularly limited herein. For convenience of explanation, the dressing assistance method will be described with reference to an example in which the garment 24 is a stocking to be put on the leg of a user, as illustrated in FIG. 7. Additionally, herein, reference will be made to a user of the dressing assistance device 100, but it should be understood that the user referred to herein may be the individual using the dressing assistance device 100 to put on the garment 24, or an assistant (e.g., family member or caretaker) to the individual using the dressing assistance device 100 to put on the garment 24.

First, as illustrated in FIG. 7, in Step 1, the user of the dressing assistance device 100 may configure the dressing assistance device 100 to the deployed state illustrated in FIGS. 1-5, and attach the garment 24 to the garment mount section 8. More particularly, the user of the dressing assistance device 100 may rotate the first and second erectable members 2V1, 2V2 of the rotatable frame section 2R around the first set of hinges 3 to be substantially perpendicular to the horizontal surface of the floor, and use the height adjustment section 12 to adjust the height of the dressing assistance device 100 to a suitable height and angle to facilitate donning of the garment 24. Next, the user may attach the garment 24 to the garment mount section 8 in the closed position by placing the body 24*b* of garment 24 within the hollow conical frustum of the garment mount section 8 and fitting a cuff 24*c* of the garment 24 over the first circumferential edge 8*a* of the garment mount section 8 such that the opening of the garment 24 faces the user. In embodiments, the user may roll-up a portion of the garment 24 onto the garment mount section 8 to secure the garment 24 on the garment mount section 8 to prevent slippage during movement. Subsequently, the user may press a button (e.g., an "open" button) on a remote control device 26 communicably connected to the motor to cause the mount adjustment section 10 to adjust the garment mount section 8 to the open position, thereby opening the garment mount section 8 to a suitable circumference to receive the limb 22 of the user and stretching the garment opening of the garment 24. At this stage, the user of the dressing assistance device 100 may extend their limb 22 (e.g., leg) toward the garment opening of the garment 24 attached to the garment mount section 8 and partially insert their limb 22 into the garment opening. In embodiments, the user may rest a portion of their limb 22 (e.g., their heel or calf) on the second transverse member 2T2.

Next, in Step 2, the user may press a button (e.g., an "up" button) on the remote control device 26 communicably connected to the motor to cause the mount support section 6 to travel upwards along the rail guide 4 in the longitudinal direction L toward the user, such that the limb 22 of the user slides into the garment opening of the garment 24. In embodiments, prior to moving the mount support section 6 upwards, the user may press a button (e.g., a "close" button) on the remote control device 26 to cause the mount adjustment section 10 to adjust the garment mount section 8 to the closed position, such that the garment mount section 8 comfortably closes around the limb 22 of the user. The mount support section 6 may continue moving upward toward the user in the longitudinal direction L such that the movement of the mount support section 6 pulls the garment 24 completely onto the limb 22 of the user and off of the garment mount section 8. In embodiments, the mount support section 6 may continue moving until the user presses a button (e.g., "stop" button, "down" button) on the remote control device 26 to stop movement of the motor, or until the mount support section 6 reaches a predetermined stopping point.

Next, in Step 3, the user may press a button (e.g., an "open" button) on the remote control device 26 to cause the mount adjustment section 10 to open the garment mount section 8 to a suitable circumference to allow the limb 22 of the user to be removed from within the garment mount section 8.

It should be noted that while an example of a dressing assistance method for donning a garment was described above as an example, the present disclosure is not limited herein, and the dressing assistance device 100 may also be used for garment removal. More particularly, in Step 1, a user may press a button (e.g., an "open" button) on the remote control device 26 to cause the mount adjustment section 10 to adjust the garment mount section 8 to the open position, and insert their limb 22 into the garment mount section 8. Subsequently, the user may press a button (e.g., a "close" button) on the remote control device 26 to cause the mount adjustment section 10 to adjust the garment mount section 8 to the closed position around the limb 22 of the user, and the user may fit the garment opening of garment 24 worn on the limb 22 over the second circumferential edge 8*b* of the garment mount section 8. Next, in Step 2, the user may press a button (e.g., a "down" button) on the remote control device 26 communicably connected to the motor to cause the mount support section 6 to travel downwards along the rail guide 4 in the longitudinal direction L away the user, such that the garment 24 is pulled off the limb 22 of the user. The mount support section 6 may continue moving downward away from the user in the longitudinal direction L such that the movement of the mount support section 6 pulls the garment 24 completely off of the limb 22 of the user. In embodiments, the mount support section 6 may continue moving until the user presses a button (e.g., a "stop" button, an "up" button) on the remote control device 26 to stop movement of the motor, or until the mount support section 6 reaches a predetermined stopping point. Next, in Step 3, the user may press a button (e.g., an "open" button) on the remote control device 26 to cause the mount adjustment section 10 to open the garment mount section 8 to a suitable circumference to allow the limb 22 of the user to be removed from within the garment mount section 8.

In this way, according to the dressing assistance method described herein, the dressing assistance device 100 allows for a user to put on or take off a garment in an automated fashion without bending down, leaning forward, or performing other strenuous movement. For instance, in the case that the garment is a sock or stocking, the user may use the dressing assistance device 100 to put on the sock or stocking from a seated position on a chair or bed behind the dressing assistance device 100. Accordingly, it becomes possible for users with limited mobility to easily put on and take off a wide variety of garments.

As described herein, aspects of the disclosure relate to a dressing assistance device and method. The dressing assistance device may be configurable between a deployed state for assisting a user put on a garment such as a sock, stocking (e.g., compression stocking), sleeve, or the like, and a stowable state for facilitating compact storage of the dressing assistance device. The dressing assistance device may include a motor for driving a garment mount section to which a garment is attached along a guide rail to pull the garment onto or off of a limb of the user. The motor may also be configured to adjust the width of the garment mount section to stretch the attached garment to accommodate the limb of the user.

By using a motor to adjust the garment mount section to an open position when a garment is fitted onto the garment mount section, it is possible to stretch the garment opening of the garment. This can be particularly advantageous for stretching garments like compression socks having a high tensile elasticity resistance, which may prove challenging for limited-mobility users to stretch manually. Additionally, by using the motor to move the mount support section along the guide rail, it is possible to automate donning and removal of garments without bending down, leaning forward, or performing other strenuous movement. Further, by structuring the dressing assistance device to be configurable between the deployable state and the stowable state, it is possible to easily store the dressing assistance device when not in use. In this way, it is possible to provide a dressing assistance device capable of facilitating garment donning and removal while maintaining a compact, easily-storable form factor.

Definitions

The following includes definitions of selected terms employed herein. The definitions include various examples or forms of components that fall within the scope of a term and that may be used for implementation. The examples are not intended to be limiting. Both singular and plural forms of terms may be within the definitions.

An "operable connection," or a connection by which entities are "operably connected," is one in which signals, physical communications, or logical communications may be sent or received. Typically, an operable connection includes a physical interface, an electrical interface, or a data interface, but it is to be noted that an operable connection may include differing combinations of these or other types of connections sufficient to allow operable control. For example, two entities can be operably connected by being able to communicate signals to each other directly or through one or more intermediate entities like a processor, operating system, a logic, software, or other entity. Logical or physical communication channels can be used to create an operable connection.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A dressing assistance device comprising:

a rest frame structure for supporting a limb of a user;

a guide rail disposed along a longitudinal direction of the rest frame structure;

a mount support section movably connected to the guide rail;

a garment mount section operably coupled to the mount support section for receiving attachment of a garment;

a mount adjustment section operably coupled to the mount support section and configured to adjust a width of the garment mount section; and a motor operably coupled to the mount support section and the mount adjustment section, wherein the motor is configured to:

drive the mount support section to travel along the guide rail, and drive the mount adjustment section to adjust the garment mount section between a closed position for receiving attachment of a garment and an open position that allows for insertion and removal of the limb of the user, and wherein the mount adjustment section includes a clamp having:

a first jaw portion configured to interface with a first surface of the garment mount section;

a second jaw portion configured to interface with a second surface of the garment mount section that is opposite the first surface; and a mechanical actuator operably coupled to the first jaw portion, the second jaw portion, and the motor, and configured to use mechanical energy generated by the motor to apply force to the first jaw portion and the second jaw portion.

2. The dressing assistance device according to claim 1, wherein:

in the closed position, the garment mount section defines a hollow conical frustum having a first circumferential edge that defines a first opening at a first longitudinal end of the garment mount section and a second circumferential edge that defines a second opening at a second longitudinal end of the garment mount section; and the first opening has a first circumference greater than a second circumference of the second opening.

3. The dressing assistance device according to claim 2, wherein the first circumference is less than or equal to 61 centimeters.

4. The dressing assistance device according to claim 2, wherein the garment mount section is configured to receive attachment of a garment such that:

a cuff of the garment is fitted over the first circumferential edge of the garment mount section;

a body of the garment extends along the longitudinal direction within the hollow conical frustum of the garment mount section; and a garment opening of the garment is substantially concentric with the first opening of the garment mount section.

5. The dressing assistance device according to claim 4, wherein:

the limb of the user is partially inserted into the garment opening of the garment fitted over the first circumferential edge of the garment mount section; and the motor drives the mount support section to travel along the guide rail toward the limb of the user, thereby fitting the garment onto the limb of the user.

6. The dressing assistance device according to claim 1, wherein the mechanical actuator is configured to:

apply, using mechanical energy generated by the motor, force to the first jaw portion and the second jaw portion to push the first surface and the second surface of the garment mount section toward each other in a transverse direction perpendicular to the longitudinal direction to adjust the garment mount section to the closed position; and apply, using mechanical energy generated by the motor, force to the first jaw portion and the second jaw portion to pull the first surface and the second surface of the garment mount section apart from each other in the transverse direction of the dressing assistance device to adjust the garment mount section to the open position.

7. The dressing assistance device according to claim 1, wherein a garment is attached to the garment mount section in the closed position such that adjusting the garment mount section from the closed position to the open position stretches a garment opening of the garment.

8. The dressing assistance device according to claim 7, wherein the motor has an output torque characteristic that achieves a torque threshold sufficient for widening a garment opening of the garment attached to the garment mount section to a predetermined width.

9. The dressing assistance device according to claim 1, wherein the rest frame structure includes:

a longitudinal frame section having a first end portion and a second end portion; and a rotatable frame section coupled to the second end portion of the longitudinal frame section by a first set of hinges.

10. The dressing assistance device according to claim 9, wherein the rest frame structure is configurable between a deployed state and a stowable state by rotating the rotatable frame section around the first set of hinges.

11. The dressing assistance device according to claim 10, wherein, in the deployed state, the rotatable frame section is rotated around the first set of hinges to extend in a vertical direction to support the second end portion of the longitudinal frame section at a designated height.

12. The dressing assistance device according to claim 11, wherein the rotatable frame section includes a height adjustment section for adjusting a height of the second end portion of the longitudinal frame section in the deployed state.

13. The dressing assistance device according to claim 12, wherein the height adjustment section is configured to adjust the height of the second end portion of the longitudinal frame section between 30 centimeters and 51 centimeters in the deployed state.

14. The dressing assistance device according to claim 10, wherein, in the stowable state, the rotatable frame section is rotated around the first set of hinges to extend in the longitudinal direction toward the first end portion of the longitudinal frame section.

15. A dressing assistance device comprising:

a rest frame structure for supporting a limb of a user;

a guide rail disposed along a longitudinal direction of the rest frame structure;

a mount support section movably connected to the guide rail;

a garment mount section operably coupled to the mount support section for receiving attachment of a garment; and a mount adjustment section operably coupled to the mount support section and configured to adjust a width of the garment mount section, wherein:

the rest frame structure includes:

a longitudinal frame section having a first end portion and a second end portion, and a rotatable frame section coupled to the second end portion of the longitudinal frame section by a first set of hinges;

the rest frame structure is configurable between a deployed state and a stowable state by rotating the rotatable frame section around the first set of hinges;

in the deployed state, the rotatable frame section is rotated around the first set of hinges to extend in a vertical direction to support the second end portion of the longitudinal frame section at a designated height; and in the stowable state, the rotatable frame section is rotated around the first set of hinges to extend in the longitudinal direction toward the first end portion of the longitudinal frame section, and the dressing assistance device further comprises an elastic support strap extending between the rotatable frame section and the first end portion of the longitudinal frame section.

16. The dressing assistance device according to claim 15, wherein:

the longitudinal frame section includes:

a first transverse member and a second transverse member extending in a transverse direction perpendicular to the longitudinal direction;

a first longitudinal member extending between the first transverse member and the second transverse member such that a first end of the first longitudinal member is coupled to the first transverse member and a second end of the first longitudinal member is coupled to the second transverse member; and a second longitudinal member extending between the first transverse member and the second transverse member such that a first end of the second longitudinal member is coupled to the first transverse member and a second end of the second longitudinal member is coupled to the second transverse member;

the rotatable frame section includes:

a third transverse member extending in the transverse direction;

a first erectable member extending between the second transverse member of the longitudinal frame section and the third transverse member such that a first end of the first erectable member is coupled to the second transverse member and a second end of the first erectable member is coupled to the third transverse member; and a second erectable member extending between the second transverse member of the longitudinal frame section and the third transverse member such that a first end of the second erectable member is coupled to the second transverse member and a second end of the second erectable member is coupled to the third transverse member.

17. A dressing assistance method for use with a dressing assistance device, the dressing assistance device including:

a rest frame structure for supporting a limb of a user;

a guide rail disposed along a longitudinal direction of the rest frame structure;

a mount support section movably connected to the guide rail;

a garment mount section operably coupled to the mount support section for receiving attachment of a garment;

a mount adjustment section operably coupled to the mount support section and configured to adjust a width of the garment mount section; and a motor operably coupled to the mount support section and the mount adjustment section, wherein the motor is configured to:

drive the mount support section to travel along the guide rail, and drive the mount adjustment section to adjust the garment mount section between a closed position for receiving attachment of a garment and an open position that allows for insertion and removal of the limb of the user, the dressing assistance method comprising:

fitting a garment onto the garment mount section while the garment mount section is configured in the closed position;

driving the mount adjustment section with the motor to adjust the garment mount section to the open position to stretch a garment opening of the garment;

receiving insertion of a limb of the user into a garment opening of the garment;

driving the mount support section with the motor to travel along the guide rail toward the user from a predetermined starting position to a predetermined stopping position, thereby fitting the garment onto the limb of the user, receiving insertion of a limb of the user in the garment mount section;

fitting a portion of a garment worn on the limb of the user onto the garment mount section; and driving the mount support section with the motor to travel along the guide rail away from the user from a predetermined starting position to a predetermined stopping position, thereby removing the garment from the limb of the user.

* * * * *